United States Patent [19]

Suzuki et al.

[11] 4,444,522

[45] Apr. 24, 1984

[54] PAPER CLAMP DEVICE FOR A PRINTER

[75] Inventors: Teruo Suzuki; Tsuneki Kobayashi; Masao Miyasaka, all of Ibaraki, Japan

[73] Assignee: Hitachi Koki Co. Ltd., Tokyo, Japan

[21] Appl. No.: 391,036

[22] Filed: Jun. 22, 1982

[30] Foreign Application Priority Data

Jul. 8, 1981 [JP] Japan ..... 56-107268

[51] Int. Cl.[3] ..... B41J 1/20

[52] U.S. Cl. ..... 400/146; 400/247; 400/618; 400/619; 400/634; 101/93.14

[58] Field of Search ..... 101/93.14, 111; 400/146, 247, 248, 618, 619, 634

[56] References Cited

U.S. PATENT DOCUMENTS

| | | | |
|---|---|---|---|
| 2,633,828 | 4/1953 | Adkins et al. | 400/634 X |
| 3,586,149 | 6/1971 | Miller | 400/618 |
| 3,707,215 | 12/1972 | Familant | 400/618 |
| 3,732,810 | 5/1973 | Skiba et al. | 400/146 X |
| 3,915,276 | 10/1975 | Metz | 400/146 X |
| 4,072,225 | 2/1978 | Manning et al. | 400/618 X |
| 4,091,912 | 5/1978 | Moss | 400/618 X |
| 4,285,604 | 8/1981 | Rex | 400/247 |

FOREIGN PATENT DOCUMENTS

| | | | |
|---|---|---|---|
| 2363443 | 3/1978 | France | 400/618 |
| 2071015 | 9/1981 | United Kingdom | 400/247 |

*Primary Examiner*—Clifford D. Crowder
*Attorney, Agent, or Firm*—Sughrue, Mion, Zinn, Macpeak & Seas

[57] ABSTRACT

A clamping device for a printer has a plurality of sideways-slippage preventing rollers housed in a roller housing which is fixed to a rear face of a wall of a ribbon shield. These preventing rollers prevent the printing paper from slipping sideways during a printing operation. A plurality of pressing plates are fixed on a hammer cover and biased towards the preventing roller by springs. A printing paper travels between the preventing rollers and the pressing plates, and the preventing rollers are oriented to rotate in the direction in which the printing paper travels. Since the preventing rollers prevent the printing paper from slipping sideways during printing, the printing lines are aligned properly. The preventing rollers also exert a minimum forward clamping force on the printing paper, which thus prevents the paper from tearing.

6 Claims, 6 Drawing Figures

PAPER CLAMP DEVICE FOR A PRINTER

BACKGROUND OF THE INVENTION

1. Field of the Invention

The present invention relates to a paper clamp device for an impact printer.

2. Description of the Prior Art

The present invention is applicable to both a back impact printer and a front impact printer, such as those disclosed in U.S. Pat. Nos. 3,585,927 and 3,732,810.

In prior art impact printers, a type belt and a plurality of hammers are used to print information on a printing paper. A problem which often occurs in these printers is that the printed lines are commonly misaligned relative to one another. This misalignment occurs because, as the printing paper is tapped with a print hammer against a type belt to print printing characters, the type belt moves the paper sideways due to the inertial forces exerted by the type belt as it moves relative to the printing paper. In order to solve this alignment problem, a clamp device is disposed in a paper path to prevent the sideways-slippage of the printing paper.

Although prior art clamp devices prevent the sideways-slippage of the printing paper so that alignment of the printing lines can be improved, the prior art clamp devices also act as a brake, thus inhibiting the feeding motion of the paper as it is fed through the printer. This braking effect causes feed apertures, located on opposite sides of the paper, to tear and become larger. A further problem with prior art clamp devices is that, when multiple printing paper having sheets of carbon paper interposed between adjacent sheets of paper is used, the printing paper on the side of the type belt is peeled. The multiple paper 18, shown in FIGS. 1 and 2 without the carbon paper, is stapled with a paper fastener 19 outside a printing area of the paper so that each piece of printing paper is not torn. However, if the number of pieces of paper is relatively large, the clamping force of the paper fastener 19 becomes weak and causes the printing paper to be carried by the type belt and torn. As a result, the feed apertures 15 of the torn paper are disengaged with a tractor on the printer, thus increasing the possibility of the paper jamming the printer.

SUMMARY OF THE INVENTION

It is an object of the present invention to overcome the above disadvantages in the prior art by providing a clamp device for a printer that prevents the lines printed thereby from being misaligned, and that prevents the feed apertures of the printing paper from being torn.

These and other objects are achieved by providing a paper clamp device having one or more paper sideways-slippage preventing rollers which are supported in a roller housing attached to a rear face of a wall of a ribbon shield which is pivotably mounted to the printer. A peripheral portion of the preventing roller has a ring attached thereto, and this ring has a large coefficient of friction. The peripheral portion of the preventing roller protrudes through a longitudinal slot in a wall of the ribbon shield and into an area through which the printing paper travels. A pressing plate is disposed opposite the preventing roller so that the printing paper travels between the pressing plate and the preventing roller, and the pressing plate and the preventing roller are biased toward one another. Since the preventing roller is free to rotate in the direction of travel of the printing paper, a minimum clamping force is exerted by the preventing roller against the forward motion of the printing paper, and a substantial clamping force is exerted by the preventing roller against sideways-slippage of the printing paper.

DESCRIPTION OF THE PREFERRED EMBODIMENTS

Figure 1:
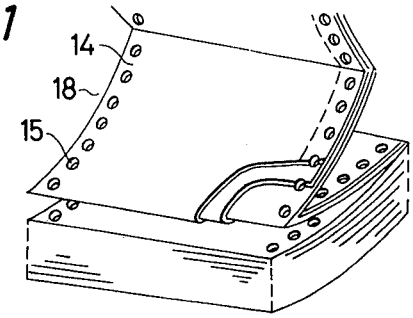
FIGS. 1 and 2 are perspective views showing multiple printing paper arrangements.
Figure 2:
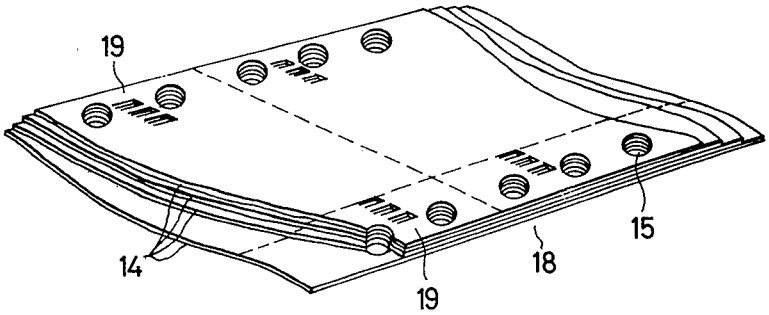
Figure 3:
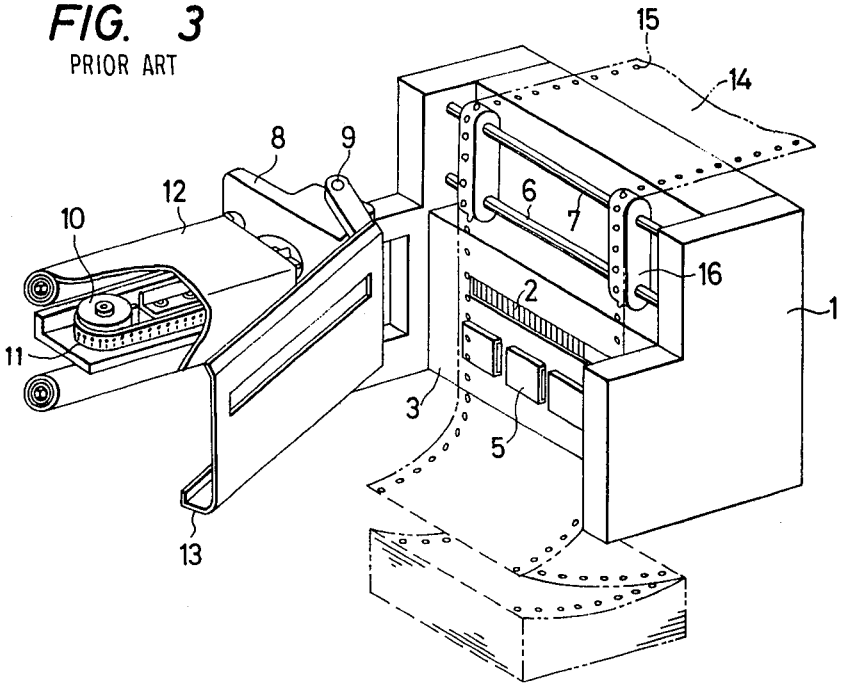
FIG. 3 PRIOR ART
FIG. 3 is a perspective view of a printer showing various components thereof.
Figure 4:
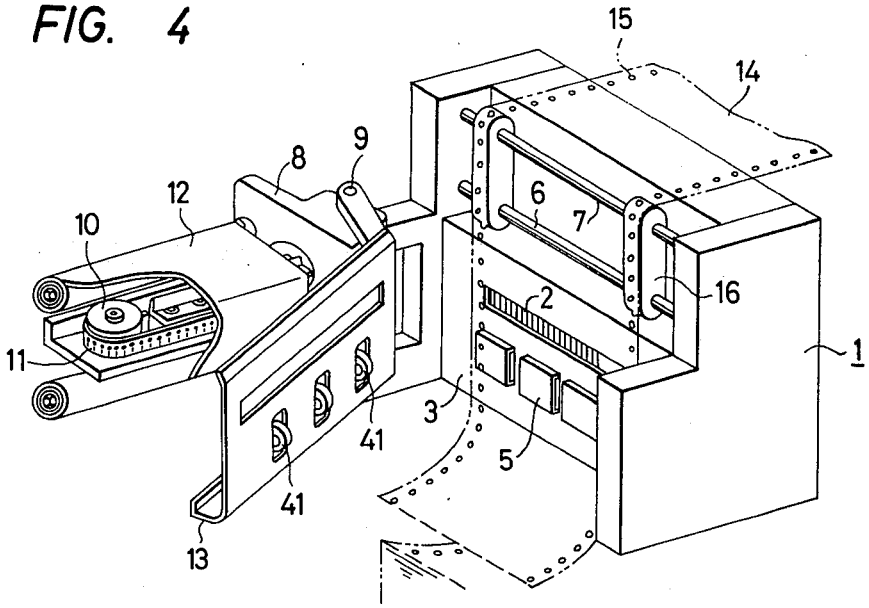
FIGS. 4 and 5 are, respectively, a perspective view and a sectional view of the principal portion of one embodiment of the present invention.
Figure 5:
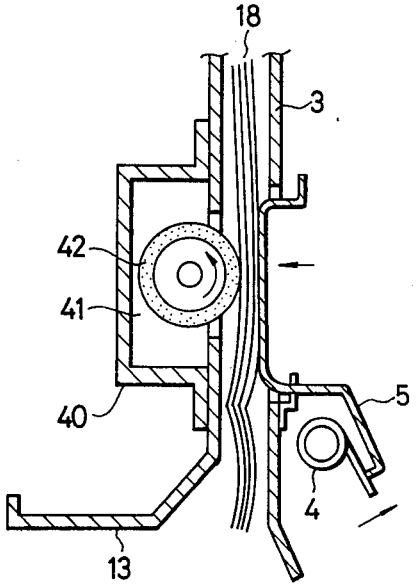

Referring to FIGS. 3 and 4, a printer is shown which has a main frame 1 that includes a hammer cover 3 having an opening for permitting tapping surfaces of a plurality of type hammers 2 to pass through the opening. The plurality of type hammers 2 are arranged parallel to a printing position or a line of a printing paper 14. The hammer cover 3 is provided with a plurality of pressing plates 5, which are arranged parallel to the line, at the lower portion thereof. A spring 4 is shown in FIG. 5, and the spring 4 biases the pressing plates 5 towards the printing paper 14. A carrier frame 8, pivotally supported on the main frame 1 through a pivot pin 9, is adapted to support a pulley 10 for driving a character carrier such as a type belt 11. An ink ribbon 12 is driven by a driving means, which is not shown in the drawings. A ribbon shield 13 is supported by the pivot pin 9, and the ribbon shield 13 has an opening corresponding to the position of the opening of the hammer cover 3. A tractor 16 for feeding the printing paper 14 is in engagement with opposite rows of feed apertures 15 on the paper 14. The tractor 16 is suppoted by a drive shaft 6 and a guide shaft 7. The pressing plates 5 are adapted to press the printing paper 14 against the ribbon shield 13 to prevent the sideways-slippage of the printing paper 14, and the pressing plates 5 and the ribbon shield 13 form a clamp device. The ribbon shield 13 forms a paper guide wall and, together with the hammer cover 3, acts as a paper guide.

A roller housing(s) 40, mounted at the back of a ribbon shield 13, has a plurality of paper sideways-slippage preventing rollers 41 located along a printing line of the printing paper 14. The rollers 41 are rotatably mounted and are capable of rotating in the same direction in which the printing paper 14 travels. A rubber ring 42, which has a large coefficient of friction, is mounted on an outer peripheral portion of the preventing roller 41 and projects into an area through which the printing paper 14 travels.

The printing paper 14 is pressed against the preventing rollers 41 and the rubber rings 42 by the pressing plates 5 which are biased by springs 4 shown in FIG. 5. The printing paper 14 is clamped by the preventing rollers 41, the rubber rings 42 and the pressing plates 5 so that sideways-slippage of the printing paper 14 is prevented. Since the preventing rollers 41 are mounted on the ribbon shield 13 facing the type belt 11, the stripping of the multiple paper 18 on the type belt 11 can be prevented. Further, since the preventing rollers 41 move in the same direction that the paper travels, the preventing rollers 41 exerts only a slight braking force on the printing paper 14, and, thus, the feed apertures 15 are not torn.

Figure 6:
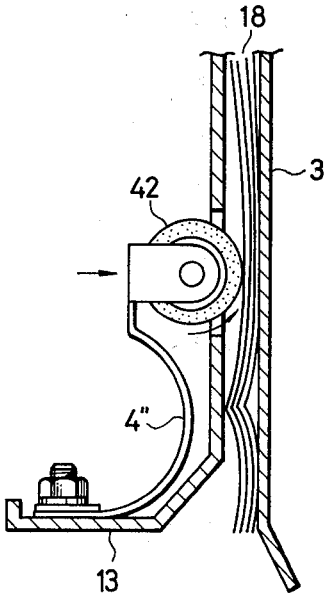
FIG. 6 is a sectional view showing an alternative embodiment of the present invention wherein a preventing roller is biased by a spring.

In the above-described embodiment, the paper pressing plates 5 are biased and urged toward the preventing rollers 41 by springs 4; thus, the rotational axis of the preventing rollers 41 are fixed. Alternatively, the preventing rollers 41 can be biased by springs 4 so that they are urged toward a fixed pressing plates as shown in FIG. 6.

As described above, when using the present invention, the sideways-slippage of the printing paper is minimized, and tearing of the printing paper also is prevented. Thus, printing quality is improved, and paper jamming is prevented.

We claim:

1. A paper clamp device for a printer having a character carrier driven along a printing line direction, a ribbon shield and a hammer cover, wherein a printing paper travels between said shield and said hammer cover during printing, comprising:

a plurality of sideways-slippage preventing rollers;

means for mounting said preventing rollers to said ribbon shield so that said preventing rollers are rotatably mounted, peripheral surfaces of said preventing rollers extending from a front face of a wall of said ribbon shield opposite said hammer cover into an area through which said printing paper travels, said preventing rollers being capable of rotating in a direction in which said printing paper travels, each preventing roller having a ring fixed to said peripheral surface thereof, said rings having a large coefficient of friction;

a plurality of pressing plates located on said hammer cover opposite respective preventing rollers, said printing paper traveling between said preventing rollers and said pressing plates;

means for biasing said pressing plates and said preventing rollers towards one another;

said plurality of preventing rollers, rings, pressing plates and said biasing means being provided along a line substantially perpendicular to said direction in which said printing paper travels, a number of said preventing rollers being equal to a number of said pressing plates;

said preventing rollers, rings, pressing plates and said biasing means inhibiting movement of said paper parallel to said printing line direction so as to oppose a sideways force imparted to said paper by said character carrier which tends to move said paper parallel to said printing line direction.

2. The paper clamp device claimed in claim 1 wherein said mounting means comprises a roller housing fixed to a rear face of said ribbon shield wall for housing said preventing roller, said roller housing and said rear face defining a confined volume for containing said preventing roller, said preventing roller extending through a longitudinal slot in said ribbon shield wall.

3. The paper clamp device claimed in claim 1 wherein said biasing means contacts said preventing roller.

4. The paper clamp device claimed in claim 1 wherein said biasing means contacts said pressing plate.

5. The paper clamp device claimed in claim 1 wherein said biasing means comprises a leaf spring.

6. The paper clamp device claimed in claim 1 further comprising means for pivotally mounting said ribbon shield to said printer.

* * * * *